United States Patent [19]

Compeau et al.

[11] Patent Number: 4,850,140

[45] Date of Patent: Jul. 25, 1989

[54] RELEASABLE CONNECTOR FOR CLOSURE OPERATING MECHANISM

[75] Inventors: David E. Compeau, Mt. Clemens; Lloyd W. Rogers, Utica, both of Mich.

[73] Assignee: General Motors Corporation, Detroit, Mich.

[21] Appl. No.: 236,418

[22] Filed: Aug. 25, 1988

[51] Int. Cl.[4] ..... E05F 11/04

[52] U.S. Cl. ..... 49/347; 49/26; 49/301; 24/602; 24/658; 24/115 F

[58] Field of Search ..... 49/347, 301, 280, 26; 24/602, 653, 656, 658, 115 F

[56] References Cited

U.S. PATENT DOCUMENTS

| | | | |
|---|---|---|---|
| 941,096 | 11/1909 | Pugatsky et al. | 24/656 |
| 1,772,854 | 8/1930 | Borresen | 24/658 |
| 2,825,112 | 3/1958 | Frieder et al. | 24/602 X |
| 3,237,977 | 3/1966 | Batchelder | 24/656 X |
| 3,413,692 | 12/1968 | Pressley | 24/602 |
| 3,984,191 | 10/1976 | Doty | 24/656 X |
| 4,739,585 | 4/1988 | Pickles | 49/280 |

*Primary Examiner*—Philip C. Kannan

*Attorney, Agent, or Firm*—Charles E. Leahy

[57] ABSTRACT

A releasable connection device for connecting a motor driven drive cable to a closure includes a pin attached to the closure and having a head supported by a necked down stem. A cylindrical housing member has an opening in a lateral wall thereof which receives the pin. A slide member is attached to the drive cable and is reciprocably carried by the housing member. The slide member has an open ended slot smaller than the head of the pin and receiving the necked down stem. A spring acts between the housing member and the slide member to urge the members to relative positions in which the head of the pin is captured to effect a connection between the drive cable and the closure. The spring yields upon imposition of force to permit energy absorbing limited relative movement between the members and yields further to permit withdrawal of the open ended slot of the slide member beyond the head of the pin so that the pin is released from the housing member. A cam surface acts between the housing member and the head of the pin to eject the head laterally through the opening of the housing member so that the drive cable is effectively disconnected from the closure.

3 Claims, 2 Drawing Sheets

RELEASABLE CONNECTOR FOR CLOSURE OPERATING MECHANISM

The invention relates to a motor driven operating mechanism for closing a vehicle body closure and more particularly provides an energy absorbing and releasable connector releasing the closure from the motor drive upon obstruction of the closure or forced entry.

BACKGROUND OF THE INVENTION

It is known in vehicle bodies to provide a mechanism for moving a vehicle body closure between the open and closed positions.

One such mechanism is shown in U.S. patent application Ser. No. 143,779 filed Jan. 14, 1988 and assigned to the assignee of this invention. Such a vehicle closure operating mechanism includes a motor driven cable drum which winds and unwinds a cable. The end of the cable is attached to the vehicle body closure so that winding of the cable on the drum will forcibly pivot the closure to the closed position.

It would be desirable to provide a releasable connection between the cable and the closure so that continued winding of the cable after the closure encounters an obstruction would permit the cable to release from the closure, thereby preventing injury to the closure or the closure operating mechanism.

It would also be desirable to provide a releasable connection device which would release the cable from the closure in the event that the closure is forcibly moved to the open position by a manually applied effort instead of by unwinding the cable.

Furthermore, it would be desirable to provide an energy absorbing connection device between the cable and the closure so that the encounter of a force condition of magnitude less than that effecting complete release would be absorbed by the connecting device.

SUMMARY OF THE INVENTION

According to the invention a releasable connection device for connecting a motor driven drive cable to a closure includes a pin attached to the closure and having a head supported by a necked down stem. A cylindrical housing member has an opening in a lateral wall thereof which receives the pin. A slide member is attached to the drive cable and is reciprocably carried by the housing member. The slide member has an open ended slot smaller than the head of the pin and receiving the necked down stem. A spring acts between the housing member and the slide member to urge the members to relative positions in which the head of the pin is captured to effect a connection between the drive cable and the closure. The spring yields upon imposition of force to permit energy absorbing limited relative movement between the members and yields further to permit withdrawal of the open ended slot of the slide member beyond the head of the pin so that the pin is released from the housing member. A cam surface acts between the housing member and the head of the pin to eject the head laterally through the opening of the housing member so that the drive cable is effectively disconnected from the closure.

BRIEF DESCRIPTION OF THE DRAWINGS

These and other features, objects and advantages of the invention will become apparent upon consideration of the description of the preferred embodiment and the appended drawings in which.

DESCRIPTION OF THE PREFERRED EMBODIMENT

Figure 1:
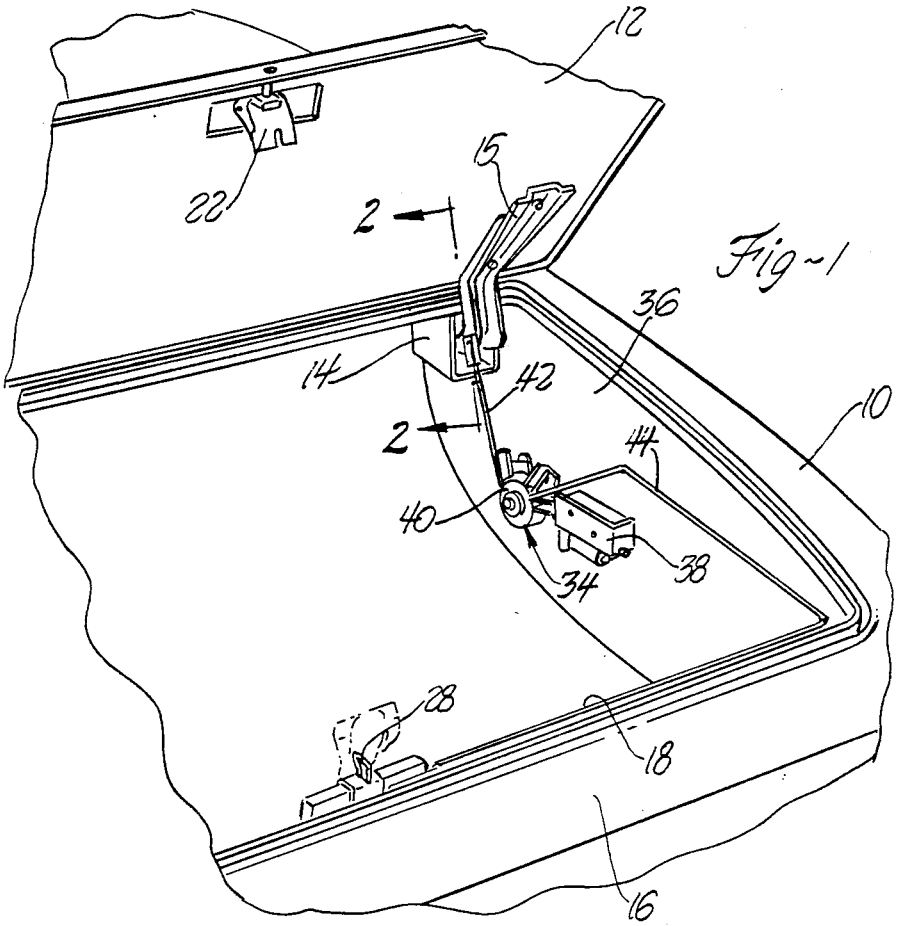
FIG. 1 is a perspective view of a vehicle body having a drum would cable attached to the deck lid closure hinge by the releasable connecting device of this invention.

Referring to FIG. 1 a deck lid closure 12 is mounted on a vehicle body 10 by a pair of hinges, one of which is shown at 14 and includes a hinge arm 15. Body panel 16 of the vehicle body 10 defines a compartment opening 18 which is opened and closed by the closure 12. A spring, not shown, urges the closure 12 to the open position shown in FIG. 1. The closure 12 may be latched in a closed position by a latch assembly 22 mounted on the closure 12. The latch assembly 22 includes a latch bolt which is engageable with a striker 28 carried by the body panel 16 to latch and interconnect the closure 12 with the body panel 16. The latch assembly 22 also includes a key operated lock cylinder which is rotatable to unlatch the latch bolt from the striker 28 and enable the closure panel 12 to be moved to its FIG. 1 open position by the closure spring.

A motorized drive unit, generally indicated at 34, is provided to pull the closure 12 downwardly to latch the latch assembly 22 with the striker 28, and to also pull the striker 28 down to seal the closure 12 at its fully closed position. This motorized drive unit 34 is mounted on the side wall structure 36 of the vehicle body 10 and includes a motor 38 which reversibly rotates a cable drum 40. The cable drum 40 winds and unwinds a cable 42 connected to the hinge arm 15 and a cable 44 connected to the striker 28.

Reference may be had to patent application Ser. No. 143,779 for a complete description of the construction and sequence of operation of the closure operating mechanism, including the latch 22, the striker 28 and the motorized drive unit 34. For purposes of the present invention, it will be understood that the motor 38 rotates drum 40 in a direction to wind the cable 42 so that the closure panel 12 is pivoted downwardly to its closed position. In the event that an obstruction blocks the downward pivoting movement of the closure 12, the cable 42 may experience an excessive tension. Furthermore, in the event that the operator attempts to forcibly open the closure 12 against the winding effort of the motor 38 retracting the cable 42, the cable 42 may experience an excessive tension.

Figure 2:
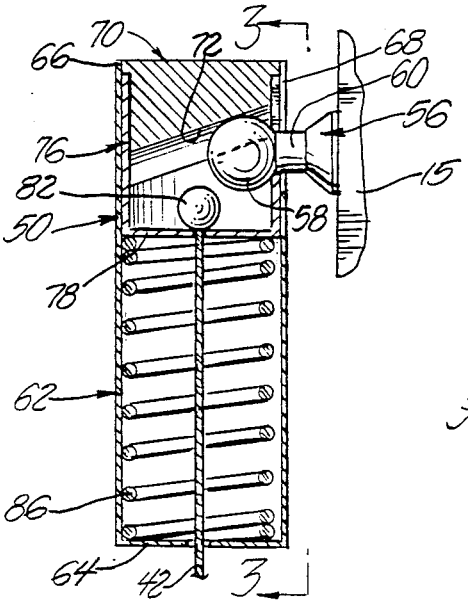
FIG. 2 is a sectional view taken in the direction of arrows 2—2 of FIG. 1 and having parts broken away in section to show the construction of the releasable connecting device.
Figure 3:
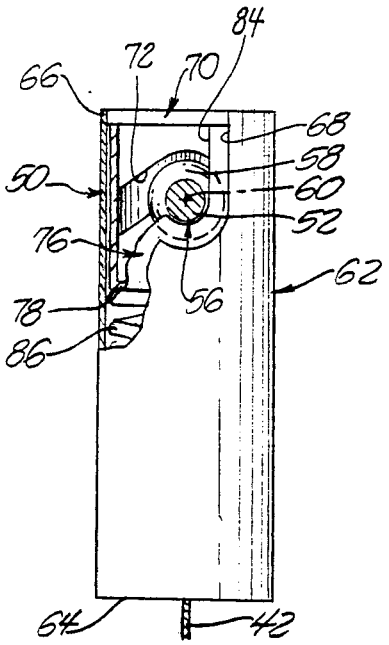
FIG. 3 is a view taken in the direction of arrows 3—3 of FIG. 2.

Referring to FIGS. 2 and 3, a releasable connecting device 50 is provided for connecting the cable 42 with the hinge arm 15 of closure hinge 14.

A pin 56 is attached to the hinge arm 15 and includes a spherical head 58 mounted on a necked down stem 60. The pin 56 extends laterally from the hinge arm 15. A circular cylindrical housing 62 has a closed lower end 64 and an open upper end 66. An opening 68 is provided in the wall of the housing member 62 and is large enough to receive the head 58 of pin 56. The open end 66 of the housing member 62 is closed by a plug 70 which is press fit into the end of the housing member 62 and has a cam surface 72 facing toward and engageable with head 58.

A circular cylindrical slide member 76 is reciprocably slidable within the housing member 62. The cable 42 passes through the bottom wall 64 of the housing member 62 and through a bottom wall 78 of the slide member 76. A ball 82 is swaged onto the end of the cable 42 to attach the cable 42 to the slide member 76. As best seen in FIG. 3, the slide member 76 has an open ended slot 84 which is smaller than the head 58 of pin 56 and receives the stem 60 of pin 56.

A coil compression spring 86 is captured inside the housing member 62 having its lower end seated on the bottom wall 64 and has its upper end acting against the bottom wall 78 of slide member 76. Accordingly, as best seen in FIGS. 2 and 3, the coil compression spring 86 urges the slide member 76 upwardly in relation to the housing member 62 so that the pin 56 is trapped between the housing member 62 and the slide member 76 with the head 58 captured inside slide member 76. In particular, the top surface of the pin head 58 bears against the cam surface 72, while the open end slot 84 of slide member 76 bears against the underside of the pin stem 60.

In operation, it will be understood that the preload on the coil compression spring 86 is sufficient to maintain the housing member 62 and slide member 76 at their relative axial positions shown in FIG. 3 during normal operation of the closure operating mechanism. In particular, as the cable 42 is wound up by the motor driven drum 40, the cable 42 pulls the connector device downwardly thereby lowering the closure 10.

Figure 4:
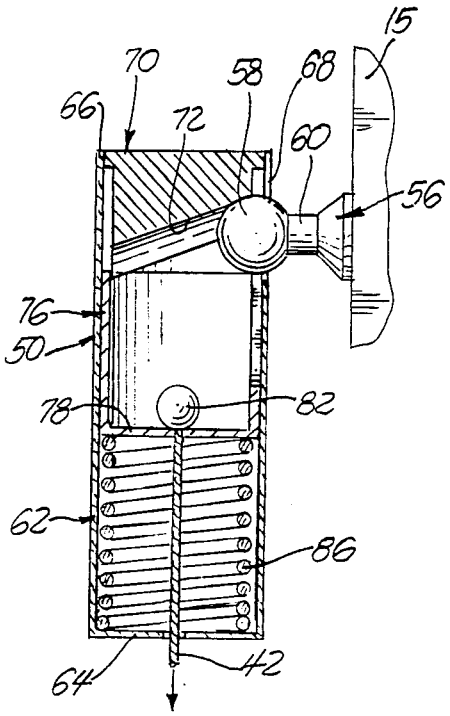
FIG. 4 is a view similar to FIG. 2 but showing the releasable connecting device in the act of disconnecting the drive cable from the closure panel.

In the event that an obstruction is encountered by the closure 10 during its closing movement, the tension on the cable 42 is increased. If the tension on the cable exceeds the preload on the coil compression spring 86, the slide member 76 will begin to move axially within the housing member 62 as shown in FIG. 4. This relative movement and the simultaneous collapsing of the spring 86 will absorb energy. If the relative travel between the slide member and housing member continues, the slot 84 of the slide member 76 is gradually withdrawn from its engagement with the underside of the pin head 58. As the wall of the open end slot 84 progressively disengages the head 58, the incline of the cam surface 72 carried by the housing member 62 will cause the connector device 50 to move laterally with respect to the pin head 58 so that the housing member is eventually ejected from the pin head 58.

The extent of energy absorbing movement obtained prior to release may be varied by choosing the length of the slot 86 and the spring rate and preload of compression spring 86.

The connector device 50 will also release from the pin 56 if the vehicle user attempts to forcibly raise the closure 10 without waiting for the cable 42 to be unwound from the drum 40.

It will be appreciated that the connector device 50 may be readily reinstalled on the pin 56. In particular, the cable 42 is pulled in one direction and the housing member 62 is pulled in the opposite direction to collapse the spring 86 as shown in FIG. 4 so that the opening 68 of housing member 62 may be reinstalled over the pin head 58.

Furthermore, it will be understood that the pin 56 may be attached to the cable 42 and the connection device 50 attached to the hinge arm 15.

Thus it is seen that the invention provides an energy absorbing and releasing connector device for coupling a motorized drive unit with a closure.

The embodiments of the invention in which an exclusive property or privilege is claimed are defined as follows:

1. An energy absorbing and releasing connection device for attaching a motor driven drive element to a vehicle body closure element, comprising:

a pin having a head supported by a necked down stem attached to one of the elements;

a housing member having an opening in a lateral wall thereof receiving the pin;

a slide member attached to the other element and reciprocably carried by the housing member and having an open ended slot smaller than the head of the pin and receiving the necked down stem of the pin;

and spring means acting between the housing member and the slide member and urging the members to relative positions in which the head of the pin is retained between the housing member and the slide member to effect a connection between motor driven drive element and the vehicle body closure element;

said spring means yielding upon imposition of force to permit energy absorbing limited relative movement between the members and yielding further to permit withdrawal of the open ended slot beyond the head of the pin whereby the pin is released from the housing member to disconnect the drive element from the closure element.

2. An energy absorbing and releasing connection device for attaching a motor driven drive element to a vehicle body closure element, comprising:

a pin having a head supported by a necked down stem attached to one of the elements;

a housing member having an opening in a lateral wall thereof receiving the pin;

a slide member attached to the other element and reciprocably carried by the housing member and having an open ended slot smaller than the head of the pin and receiving the necked down stem of the pin;

spring means acting between the housing member and the slide member and urging the members to relative positions in which the head of the pin is retained between the housing member and the slide member to effect a connection between motor driven drive element and the vehicle body closure element;

said spring means yielding upon imposition of force to permit energy absorbing limited relative movement between the members and yielding further to permit withdrawal of the open ended slot beyond the head of the pin to release the pin from the housing member;

and a cam surface acting between the housing member and the head of the pin and acting to eject the head laterally through the opening in the housing member whereby the drive element is effectively disconnected from the closure element.

3. An energy absorbing and releasing connection device for attaching a motor driven drive element to a vehicle body closure element, comprising:

a pin having a head supported by a necked down stem attached to one of the elements;

a cylindrical housing member having an opening in a lateral wall thereof receiving the pin;

a cylindrical slide member attached to the drive element and reciprocably carried by the housing member and having an open ended slot smaller than the head of the pin and receiving the necked down stem of the pin;

spring means acting between the housing member and the slide member and urging the members to relative positions in which the head of the pin member is retained between the housing member and the slide member to effect a connection between motor driven drive element and the vehicle body closure element and yielding upon imposition of force to permit limited relative movement between the members and withdrawal of the open ended slot beyond the head of the pin to release the pin from the housing member;

and a cam surface acting between the housing member and the head of the pin and acting to eject the head laterally through the opening in the housing member whereby the drive element is effectively disconnected from the closure element.

* * * * *